US009534768B2

(12) United States Patent
Huang

(10) Patent No.: US 9,534,768 B2
(45) Date of Patent: Jan. 3, 2017

(54) LIGHT CONVERGENCE MODULE WITH HEAT DISSIPATION FUNCTION

(71) Applicant: Kuo-Chin Huang, Tainan (TW)

(72) Inventor: Kuo-Chin Huang, Tainan (TW)

( * ) Notice: Subject to any disclaimer, the term of this patent is extended or adjusted under 35 U.S.C. 154(b) by 288 days.

(21) Appl. No.: 14/324,372

(22) Filed: Jul. 7, 2014

(65) Prior Publication Data

US 2015/0167953 A1 Jun. 18, 2015

(30) Foreign Application Priority Data

Dec. 13, 2013 (TW) ..... 102223609 U

(51) Int. Cl.

| | |
|---|---|
| ***F21V 29/74*** | (2015.01) |
| ***F21V 19/00*** | (2006.01) |
| *F21V 13/04* | (2006.01) |
| *F21V 5/04* | (2006.01) |
| *F21V 29/70* | (2015.01) |
| *F21Y 101/00* | (2016.01) |

(52) U.S. Cl.
CPC ..... *F21V 19/004* (2013.01); *F21V 19/0035* (2013.01); *F21V 13/04* (2013.01); *F21V 19/0045* (2013.01); *F21V 29/70* (2015.01); *F21Y 2101/00* (2013.01)

(58) Field of Classification Search
CPC ..... F21V 13/04; F21V 19/00–19/0045; F21V 17/005; F21V 17/06; F21V 17/04; F21V 17/10; F21V 17/16; F21V 17/162–17/168
See application file for complete search history.

(56) References Cited

U.S. PATENT DOCUMENTS

| | | | | |
|---|---|---|---|---|
| 2004/0066142 | A1* | 4/2004 | Stimac | F21K 9/137 315/50 |
| 2011/0157888 | A1* | 6/2011 | Chen | F21S 8/00 362/235 |
| 2011/0157901 | A1* | 6/2011 | Chen | F21V 17/164 362/373 |
| 2015/0153635 | A1* | 6/2015 | Chen | G03B 21/16 362/287 |

* cited by examiner

*Primary Examiner* — Renee Chavez
*Assistant Examiner* — Colin Cattanach
(74) *Attorney, Agent, or Firm* — Rosenberg, Klein & Lee

(57) ABSTRACT

A light convergence module with a heat dissipation function is revealed. It comprises a substrate, an assembling unit, a light convergence lampshade, and a heat sink, wherein the assembling unit with a first surface assembling to the substrate and a second surface assembling to the light convergence lampshade comprises a locating block and a plurality of position limiting blocks for respectively engaging with a locating slot and a plurality of position limiting slots of the substrate, and two buckles for correspondingly clasping two concave slots of the substrate to limit the substrate in position, and wherein the heat sink comprises a plurality of interspaces formed between every two adjacent heat dissipation fins for securing the buckles of the assembling unit and allowing the heat sink to closely dispose on the substrate.

12 Claims, 11 Drawing Sheets

LIGHT CONVERGENCE MODULE WITH HEAT DISSIPATION FUNCTION

BACKGROUND OF THE INVENTION

1. Field of the Invention

The present invention relates to a light convergence module with a heat dissipation function, which comprises a heat sink and other components to be directly assembled together without use of any other tool.

2. Description of Related Art

Generally, a light convergence module comprises a substrate, a luminous source (e.g. a light emitting diode) disposed on the substrate, an assembling unit disposed on an external surface of the substrate for connection to the substrate by a plurality of fastening elements, and a light convergence lampshade disposed on the assembling unit for collecting light and projecting it outwardly, so as to achieve effect of light convergence and illumination.

However, assembling the substrate and the assembling unit of aforementioned light convergence module by fastening elements is time-consuming and other necessary tools are needed in completion thereof. Moreover, the traditional light convergence module doesn't have a heat dissipation structure so that heat generated from the luminous source cannot dissipate immediately, leading to damage of the luminous source after working in a high temperature environment for a long time. Especially, the luminous source for illumination must have high power, so it usually generates much heat when emitting light and is prone to damage. Therefore, it is imperative to solve such an overheating problem as generally arisen in high-power LEDs.

SUMMARY OF THE INVENTION

In view of the above-mentioned problems, the object of the present invention is to provide a light convergence module with a heat dissipation function. It comprises a substrate, an assembling unit, a light convergence lampshade, and a heat sink, all of which can be directly assembled together without use of any other tools. The light convergence module allows heat generated from the luminous source to dissipate and prevent damage of the luminous source, so as to prolong life of the luminous source. Moreover, the light convergence module further has a light reflecting semi-shield. Whether the luminous source is a LED having a large reflection angle or a LED having a small reflection angle, the light reflecting semi-shield can collect all of the light emitted by the luminous source and then convert it into a reflection angle required by a terminal lens to enhance light intensity projected from the terminal lens and to increase an area of a lower section of a projected light shape.

Disclosed herein is light convergence module with a heat dissipation function, comprising:

a substrate having a luminous source in an center thereof and having a locating slot, a plurality of position limiting slots, and two concave slots on a bordering thereof, wherein each of the two concave slots is disposed between the locating slot and each of the plurality of position limiting slots or between two of the plurality of position limiting slots;

an assembling unit having a first surface and a second surface, wherein the first surface for assembling to the substrate comprises a perforation disposed coaxially relative to the luminous source for receiving the luminous source, a locating block for engaging with the locating slot, a plurality of position limiting blocks for correspondingly engaging with the plurality of position limiting slots, and two buckles for correspondingly clasping the two concave slots;

a light convergence lampshade assembling to the second surface of the assembling unit; and a heat sink having a plurality of main bodies radially extended from an center thereof, wherein each of the plurality of main bodies is provided with a plurality of heat dissipation fins on both sides thereof, and a plurality of interspaces are formed between every two adjacent heat dissipation fins for securing the buckles and allowing the heat sink to closely dispose on the substrate.

According to an embodiment of the present invention, the light convergence module further has a collecting lens disposed coaxially relative to the luminous source for inserting in the perforation of the assembling unit, and wherein the collecting lens has an effective incidence angle equal to or greater than a reflection angle of the luminous source and has an reflection angle equal to or less than an effective incidence angle of the light convergence lampshade.

According to an embodiment of the present invention, a first engagement portion is provided on a circumference of the perforation of the assembling unit, and a second engagement portion is provided on an outer sidewall of the collecting lens for correspondingly engaging with the first engagement portion.

According to an embodiment of the present invention, a light emission surface of the light convergence lampshade is divided into a first curved surface, a second curved surface, a third curved surface and a fourth curved surface in a clockwise direction based on an X axis and a Y axis intersecting with each other, the "axis line" is defined as a boundary between two of the first, second, third and fourth curved surfaces adjacent to each other, an arbitrary dot at the "axis" has a curvature identical to the curvatures of two dots corresponding to the "axis" at the two adjacent curved surfaces, and an X-axis curvature is not equal to a Y-axis curvature when the X-axis curvature of the first and fourth curved surfaces is identical to that of the second and third curved surfaces and when the Y-axis curvature of the first and second curved surfaces is identical to that of the third and fourth curved surfaces.

According to an embodiment of the present invention, the assembling unit has a plurality of engaging blocks each having an engaging recess on the second surface thereof, and the light convergence lampshade has a plurality of engaging slots, each of which has a protrusion on a side thereof for engaging with the engaging recess, so as to correspondingly receive the plurality of engaging blocks, and a rotary positioning groove extended from an opening of the engaging slot thereof.

According to an embodiment of the present invention, the assembling unit has a plurality of engaging blocks each having an engaging recess on the second surface thereof, and the light convergence lampshade has a plurality of engaging slots, each of which has a protrusion on two sides thereof for engaging with the engaging recess, so as to correspondingly receive the plurality of engaging blocks, and a positioning portion extended from an opening of the engaging slot thereof.

According to an embodiment of the present invention, the light convergence module further has a light reflecting semi-shield disposed between the light convergence lampshade and the assembling unit for reflecting and gathering a light scattered from an upper section of the luminous source to increase an area of a lower section of a projected light shape.

DETAILED DESCRIPTION OF THE PREFERRED EMBODIMENT

Hereinafter, an exemplary embodiment of the present invention will be described in detail with reference to the accompanying drawings.

Figure 1:
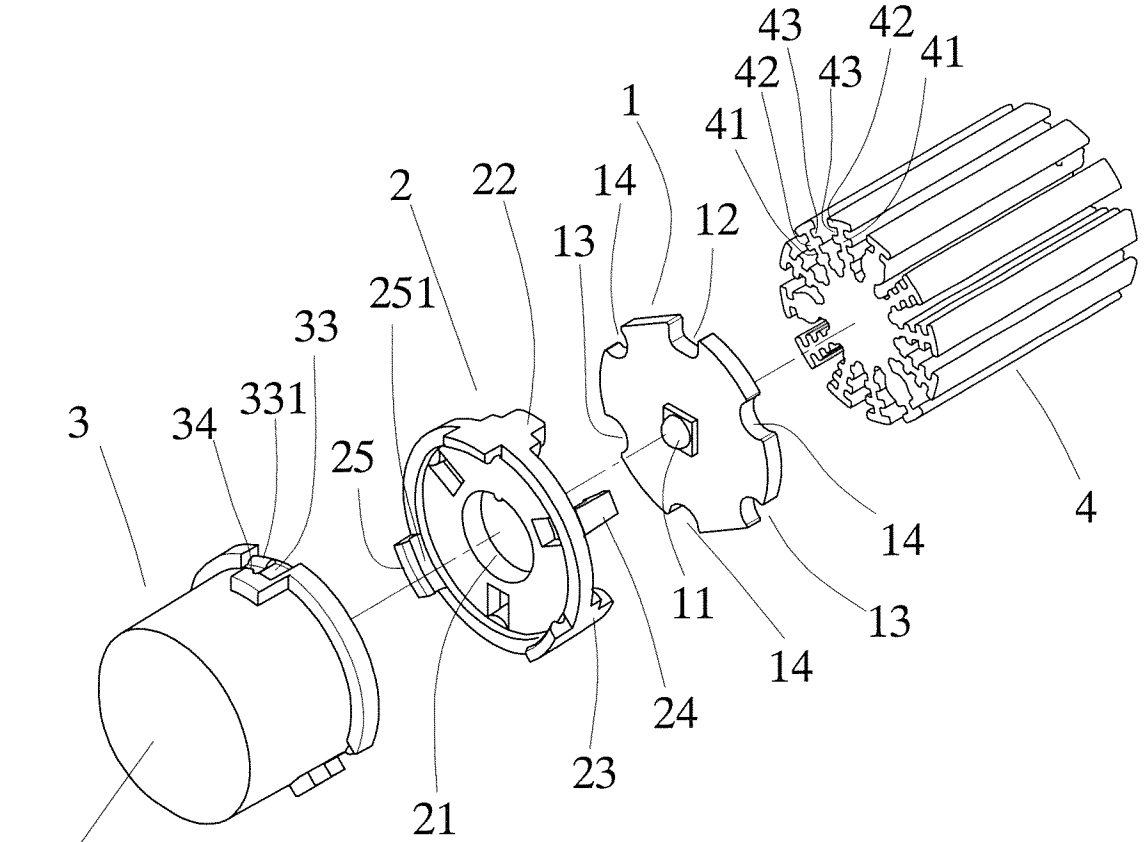
FIG. 1 is a perspective exploded view showing a first embodiment of a light convergence module with a heat dissipation function according to the present invention.
Figure 3:
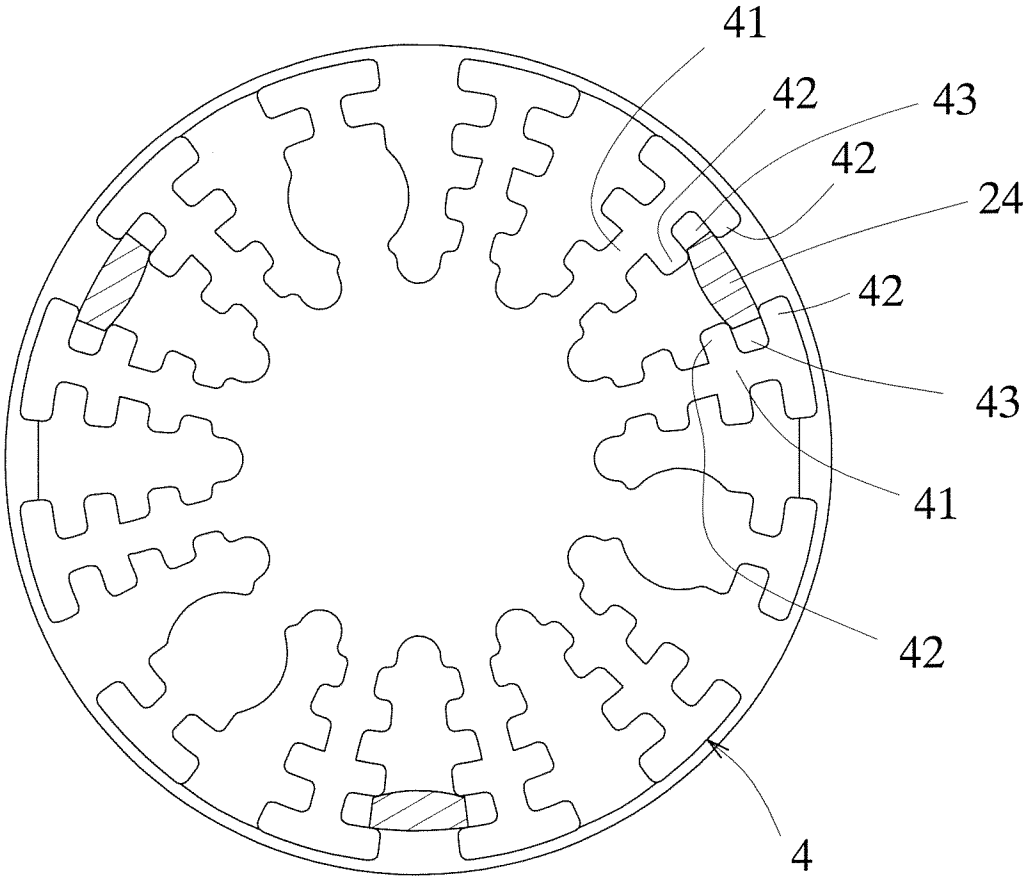
FIG. 3 is a cross-sectional view showing a buckle engaging with an interspace formed between two heat dissipation fins of a heat sink in a first of embodiment of a light convergence module with a heat dissipation function according to the present invention.

First, referring to FIG. 1, a perspective exploded view showing a first embodiment of a light convergence module with a heat dissipation function according to the present invention is revealed. The light convergence module with a heat dissipation function comprises a substrate (1) having a luminous source (11) (e.g. a light emitting diode, LED) in an center thereof and having a locating slot (12), a plurality of position limiting slots (13), and two concave slots (14) on a bordering thereof, wherein each of the two concave slots (14) is disposed between the locating slot (12) and each of the plurality of position limiting slots (13) or between two of the plurality of position limiting slots (13);

an assembling unit (2) having a first surface and a second surface, wherein the first surface for assembling to the substrate (1) comprises a perforation (21) disposed coaxially relative to the luminous source (11) for receiving the luminous source (11), a locating block (22) for engaging with the locating slot (12), a plurality of position limiting blocks (23) for correspondingly engaging with the plurality of position limiting slots (13), and two buckles (24) for correspondingly clasping the two concave slots (14) and the second surface comprises a plurality of engaging blocks (25) each having an engaging recess (251);

a light convergence lampshade (3) assembling to the second surface of the assembling unit (2), wherein the light convergence lampshade (3) has a light entrance surface (31) and a light emission surface (32) for allowing entrance and emission of light and a plurality of engaging slots (33), each of which has a protrusion (331) on a side thereof for engaging with the engaging recess (251), so as to correspondingly receive the plurality of engaging blocks (25), and a rotary positioning groove (34) extended from an opening of the engaging slot (33) thereof; and a heat sink (4) (as shown in FIG. 3) having a plurality of main bodies (41) radially extended from an center thereof, wherein each of the plurality of main bodies (41) is provided with a plurality of heat dissipation fins (42) on both sides thereof, and a plurality of interspaces (43) are formed between every two adjacent heat dissipation fins (42) for securing the buckles (24) and allowing the heat sink (4) to closely dispose on the substrate (1).

Figure 2:
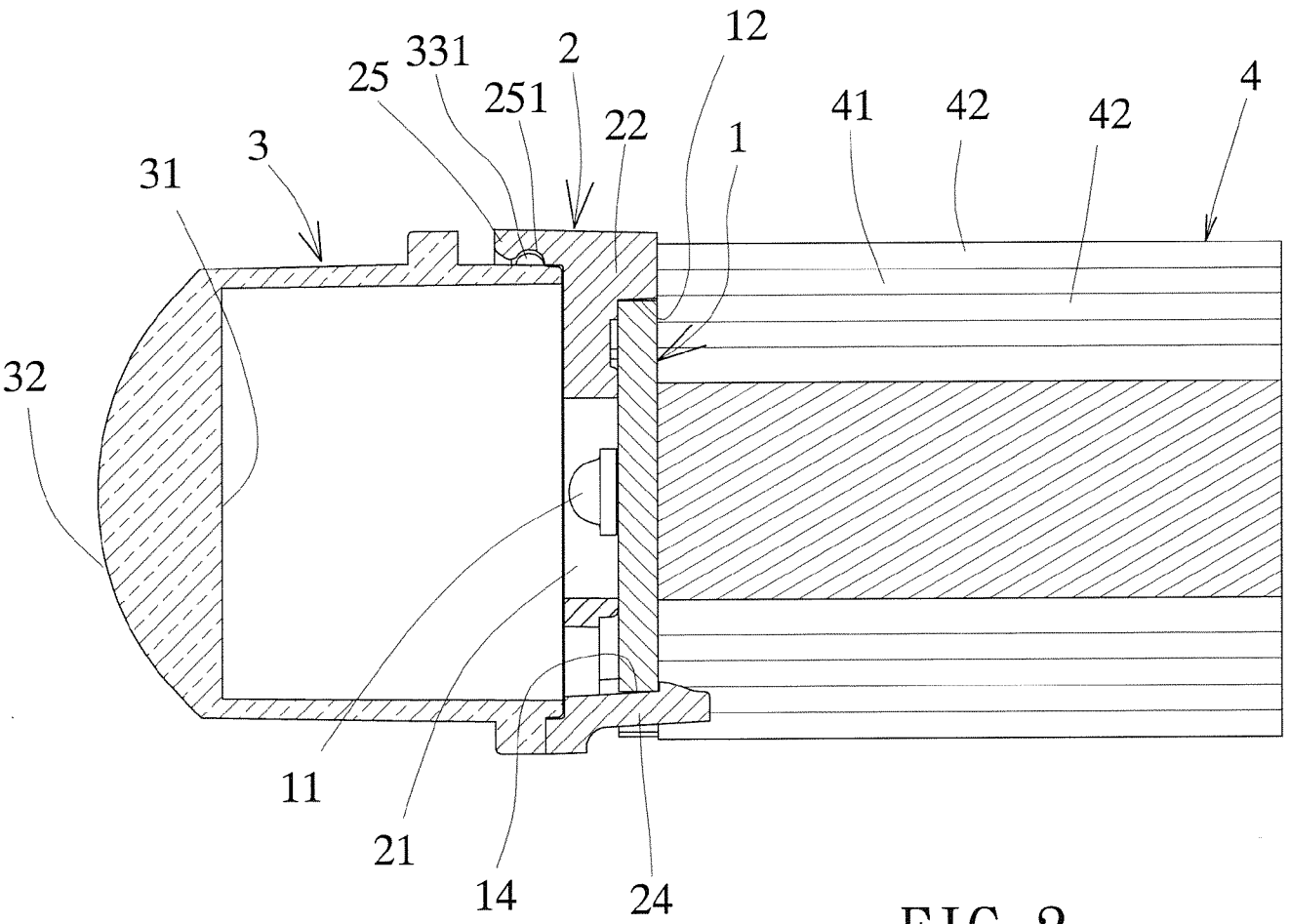
FIG. 2 is a lateral view showing a first embodiment of a light convergence module with a heat dissipation function in assembly.

In assembly of the light convergence module with a heat dissipation function, the locating block (22) correspondingly engages with the locating slot (12), and the position limiting blocks (23) insert into the position limiting slots (13), allowing the assembling unit (2) to closely dispose on the substrate (1). Moreover, two buckles (24) of the assembling unit (2) correspondingly clasp the two concave slots (14) of the substrate (1) to secure the assembling unit (2) on the substrate (1) (as shown in FIG. 2). Each of the engaging slots (33) of the light convergence lampshade (3) has a protrusion (331), and each of the engaging blocks (25) of the assembling unit (2) has an engaging recess (251) to correspondingly receive the protrusion (331). The buckles (24) of the assembling unit (2) pass through the concave slots (14) of the substrate (1) and engage with the interspaces (43) formed between every two adjacent heat dissipation fins (42), so as to make the heat sink (4) closely dispose on the substrate (1). Accordingly, the substrate (1), the assembling unit (2), and the light convergence lampshade (3) can be assembled together and limited in a predetermined position by rotating the rotary positioning groove (34). The light convergence lampshade (3) can collect light emitted from the luminous source (11) and passing through the perforation (21) of the assembling unit (2). Moreover, the heat sink (4) closely disposed on the substrate (1), allowing heat generated from the luminous source (11) to dissipate by the heat dissipation fins (42).

Figure 4:
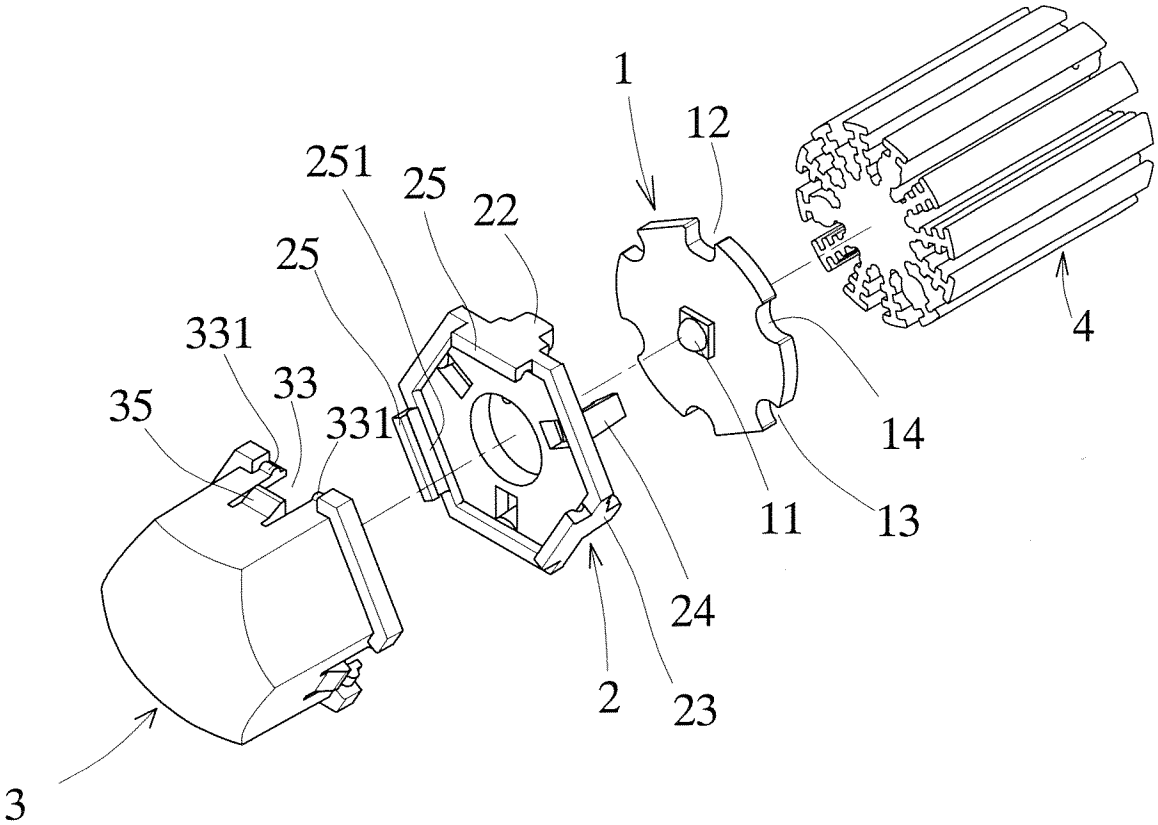
FIG. 4 is a perspective exploded view showing a second embodiment of a light convergence module with a heat dissipation function according to the present invention.

Referring to FIG. 4, a perspective exploded view showing a second embodiment of a light convergence module with a heat dissipation function according to the present invention is revealed, which is different from the first embodiment. The light convergence module has two engaging slots (33) each having a protrusion (331) on two sides thereof for engaging with the engaging blocks (25) of the assembling unit (2) and a positioning portion (35) extended from an opening of the engaging slot (33). The locating block (22) correspondingly engages with the locating slot (12), and the position limiting blocks (23) insert into the position limiting slots (13), allowing the assembling unit (2) to closely dispose on the substrate (1). Moreover, two buckles (24) of the assembling unit (2) correspondingly clasp the two concave slots (14) of the substrate (1) to limit the assembling unit (2) in position. Each of the engaging slots (33) of the light convergence lampshade (3) has a protrusion (331), and each of the engaging blocks (25) of the assembling unit (2) has an engaging recess (251) to correspondingly receive the protrusion (331).

Figure 5:
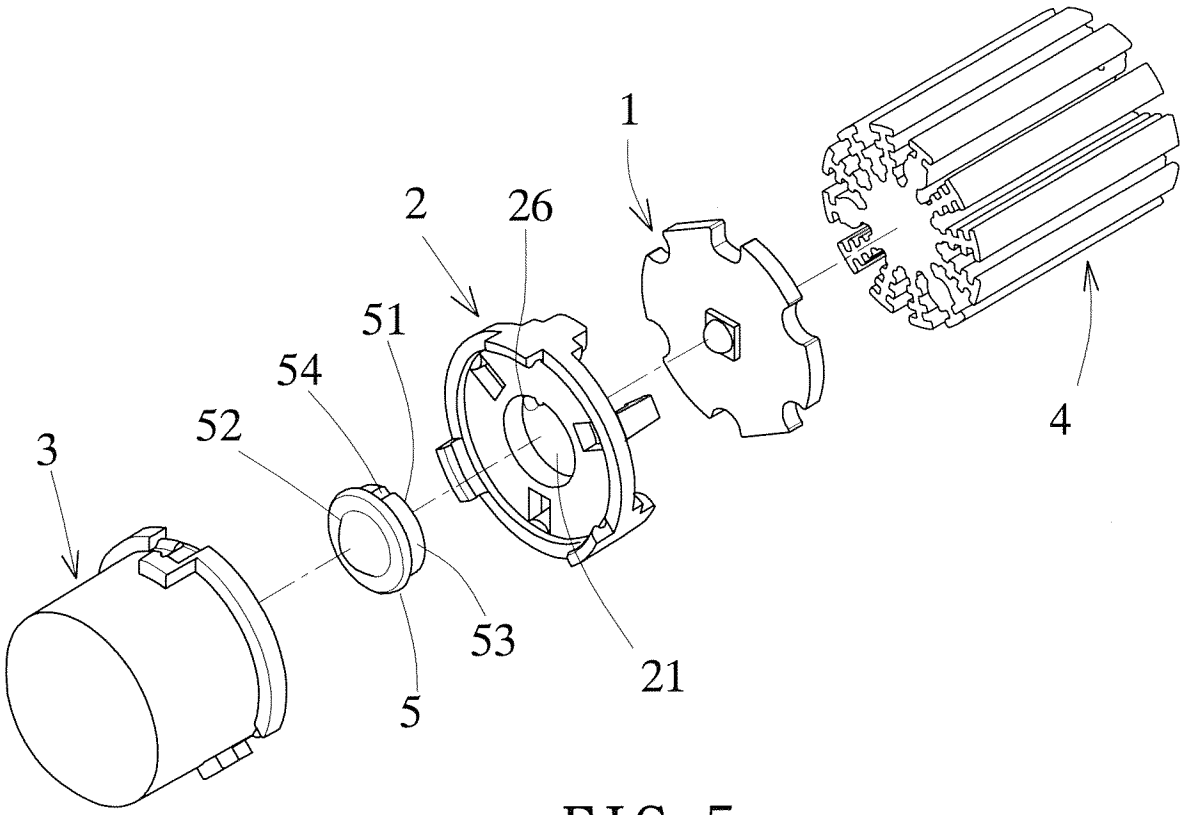
FIG. 5 is a perspective exploded view showing a third embodiment of a light convergence module with a heat dissipation function according to the present invention.
Figure 6:
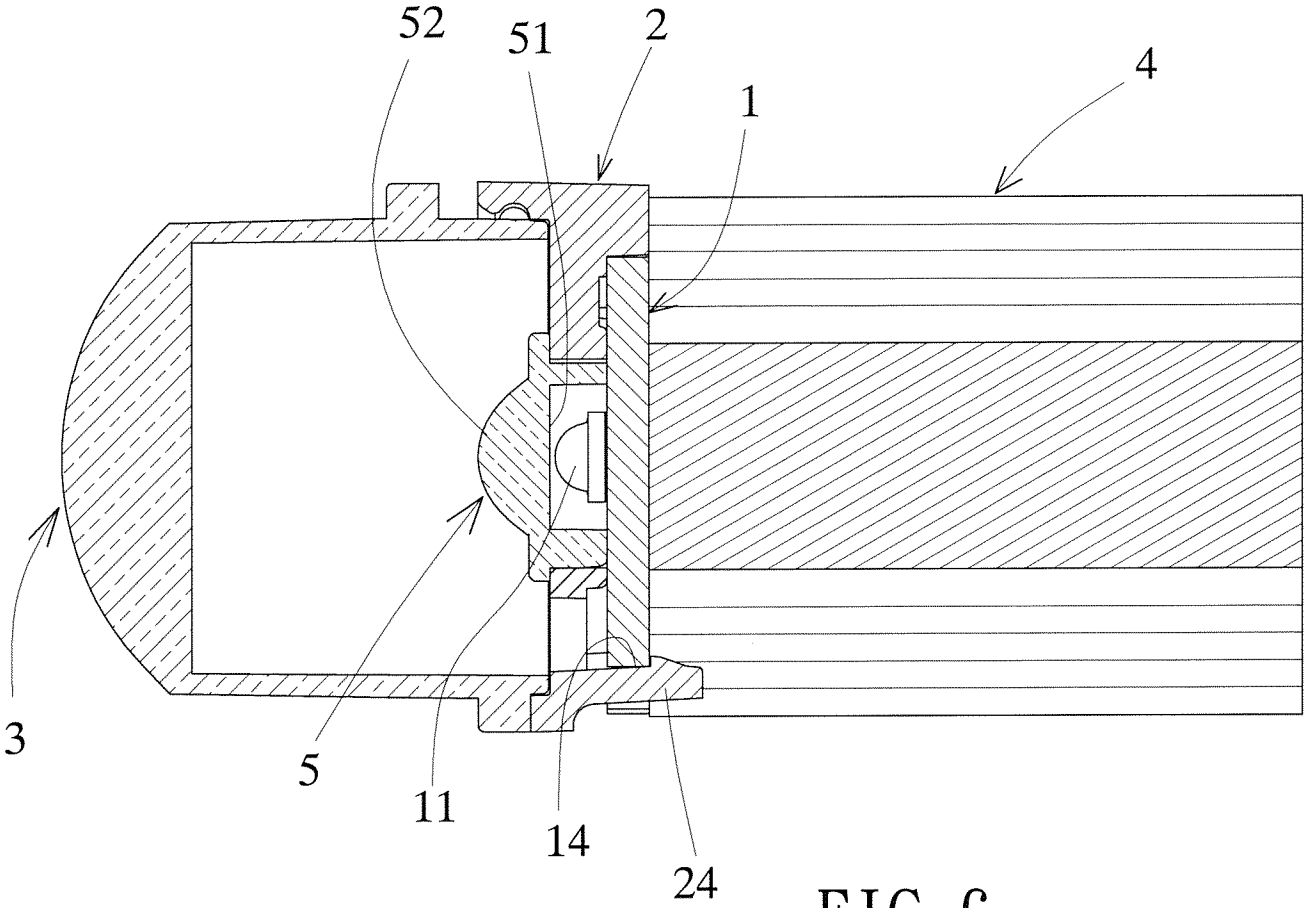
FIG. 6 is a lateral view showing a third embodiment of a light convergence module with a heat dissipation function in assembly.

Referring to FIG. 5 and FIG. 6, a third embodiment of a light convergence module with a heat dissipation function according to the present invention is disclosed. The light convergence module further has a collecting lens (5) disposed coaxially relative to the luminous source (11) of the substrate (1) for inserting in the perforation (21) of the assembling unit (2). Furthermore, the collecting lens (5) has a light entrance surface (51) toward the luminous source (11) and a light emission surface (52). An effective incidence angle of the light entrance surface (51) is equal to or greater than a reflection angle of the luminous source (11), and a reflection angle of the light emission surface (52) is equal to or less than an effective incidence angle of the light convergence lampshade (3). In addition, the collecting lens (5) has an assembling portion (53) protruded from a side toward the luminous source (11) for engaging with the perforation (21) of the assembling unit (2). The perforation (21) of the assembling unit (2) has a first engagement portion (26) on a circumference thereof for correspondingly engaging with a second engagement portion (54) provided on an outer sidewall of the collecting lens (5) so as to tightly secure the collecting lens (5) in the perforation (21) of the assembling unit (2).

Accordingly, the collecting lens (5) can collect light emitted from the luminous source (11) and project it to the light convergence lampshade (3), and then the light convergence lampshade (3) further projects light outwardly.

Figure 7:
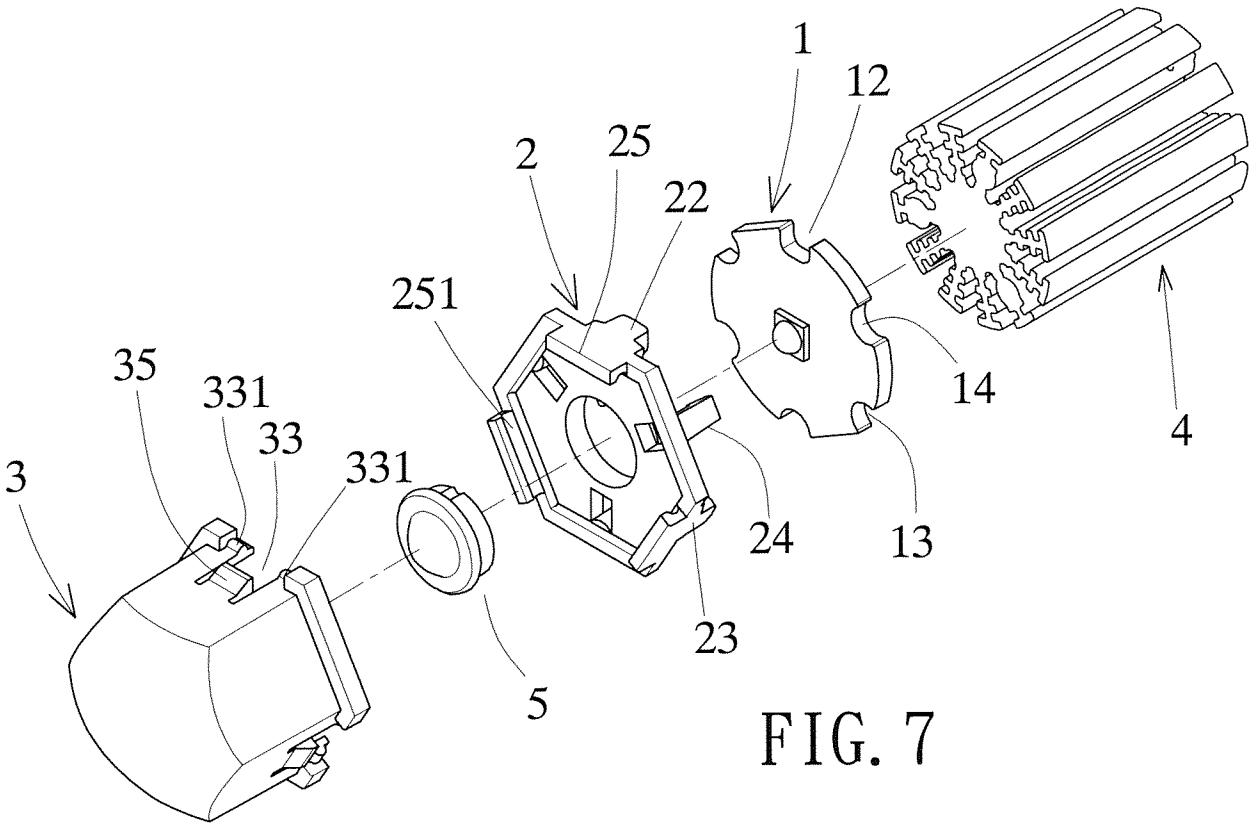
FIG. 7 is a perspective exploded view showing a fourth embodiment of a light convergence module with a heat dissipation function according to the present invention.

Referring to FIG. 7, a perspective exploded view showing a fourth embodiment of a light convergence module with a heat dissipation function according to the present invention is revealed. Compared with the third embodiment, the light convergence module in the fourth embodiment has two engaging slots (33) each having a protrusion (331) on two sides thereof for engaging with the engaging blocks (25) of the assembling unit (2) and a positioning portion (35) extended from an opening of the engaging slot (33). The locating block (22) correspondingly engages with the locating slot (12), and the position limiting blocks (23) insert into the position limiting slots (13), allowing the assembling unit (2) to closely dispose on the substrate (1). Moreover, two buckles (24) of the assembling unit (2) correspondingly clasp the two concave slots (14) of the substrate (1) to limit the assembling unit (2) in position.

Figure 8:
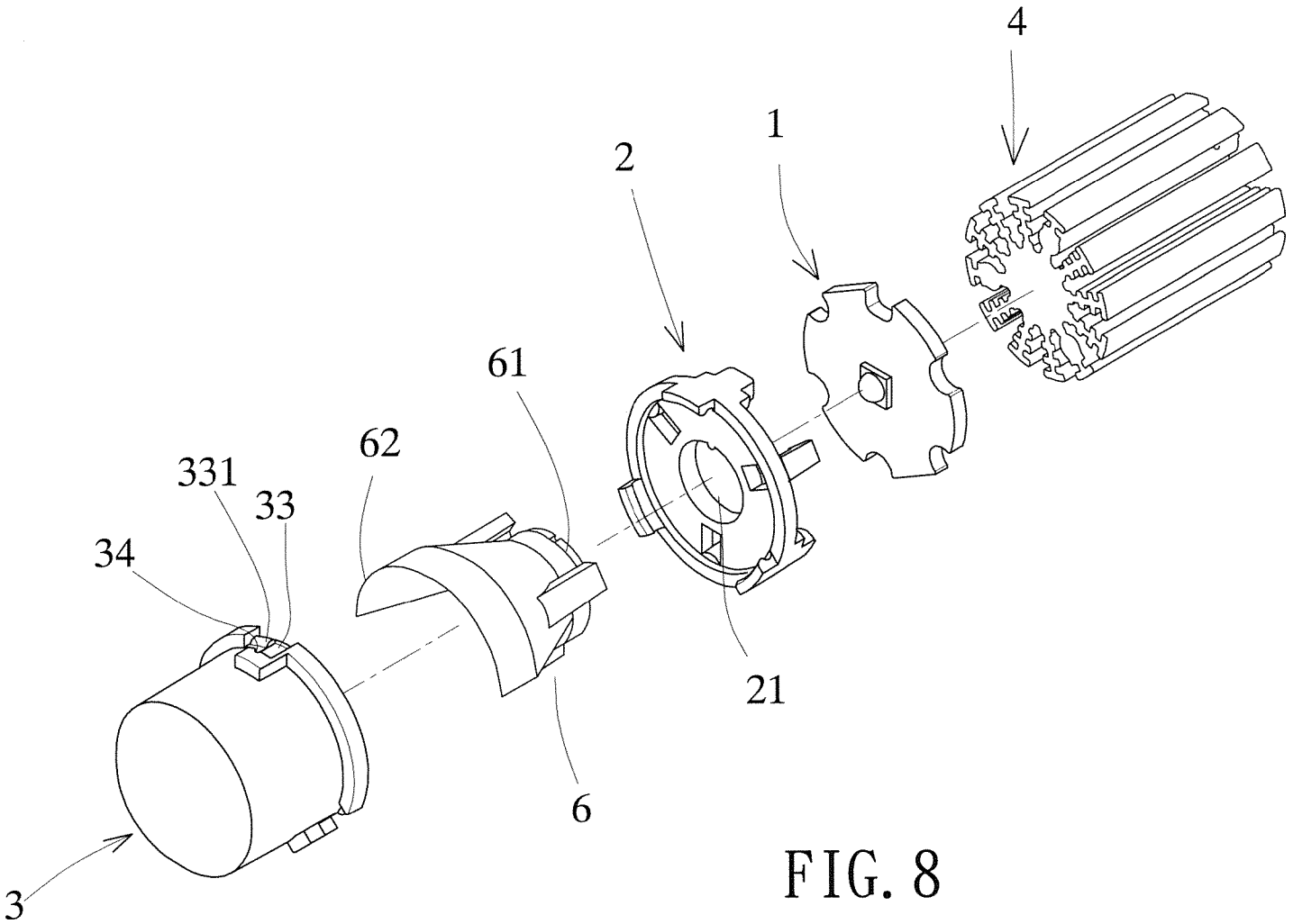
FIG. 8 is a perspective exploded view showing a fifth embodiment of a light convergence module with a heat dissipation function according to the present invention.

Referring to FIG. 8, a perspective exploded view showing a fifth embodiment of a light convergence module with a heat dissipation function according to the present invention is revealed. The light convergence module further has a light reflecting semi-shield (6) which comprises an assembling fringe (61) for correspondingly inserting into the perforation (21) of the assembling unit (2) and a light reflecting portion (62) extended from the assembling fringe (61) for disposing within the light convergence lampshade (3).

Figure 9:
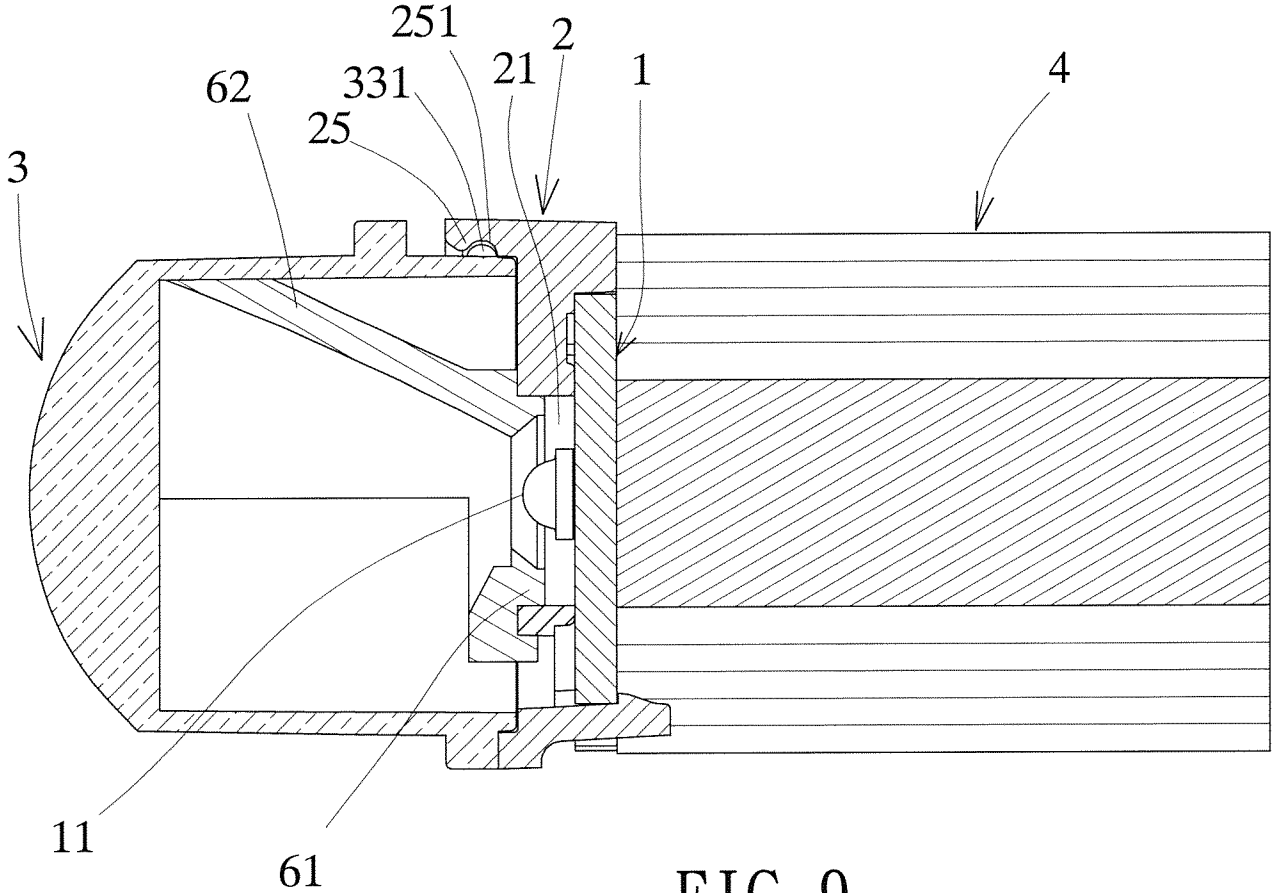
FIG. 9 is a lateral view showing a fifth embodiment of a light convergence module with a heat dissipation function in assembly.

Referring to FIG. 9, a lateral view showing a fifth embodiment of a light convergence module with a heat dissipation function in assembly is revealed. The assembling fringe (61) of the light reflecting semi-shield (6) engages with the perforation (21) of the assembling unit (2) and the engaging block (25) of the assembling unit (2) correspondingly insert into the engaging slot (33) of the light convergence lampshade (3). Moreover, the protrusion (331) of the engaging slot (33) engages with the engaging recess (251) of the engaging block (25), allowing the assembling unit (2) to closely dispose on the light convergence lampshade (3). Accordingly, the substrate (1), the assembling unit (2), the light reflecting semi-shield (6) and the light convergence lampshade (3) can be assembled together and limited in a predetermined position by rotating the rotary positioning groove (34) of the light convergence lampshade (3). Light emitted from the luminous source (11), passing through the perforation (21) of the assembling unit (2), and reflected by the light reflecting portion (62) of the light reflecting semi-shield (6) can be collected and further projected outwardly by the light convergence lampshade (3) covering the light reflecting semi-shield (6). Because the light reflecting portion (62) of the light reflecting semi-shield (6) forms a half-arc shape corresponding to an upper section of the luminous source (11), light emitted from the luminous source (11) can be collected and projected by the light reflecting portion (62), forming an half-arc light shape by the light convergence lampshade (3). Moreover, the light convergence lampshade (3) can directly project light continuously emitted from the luminous source (11) outwardly and generate a rectangular light shape, so as to increase an area of the light shape of the light convergence module.

Figure 10:
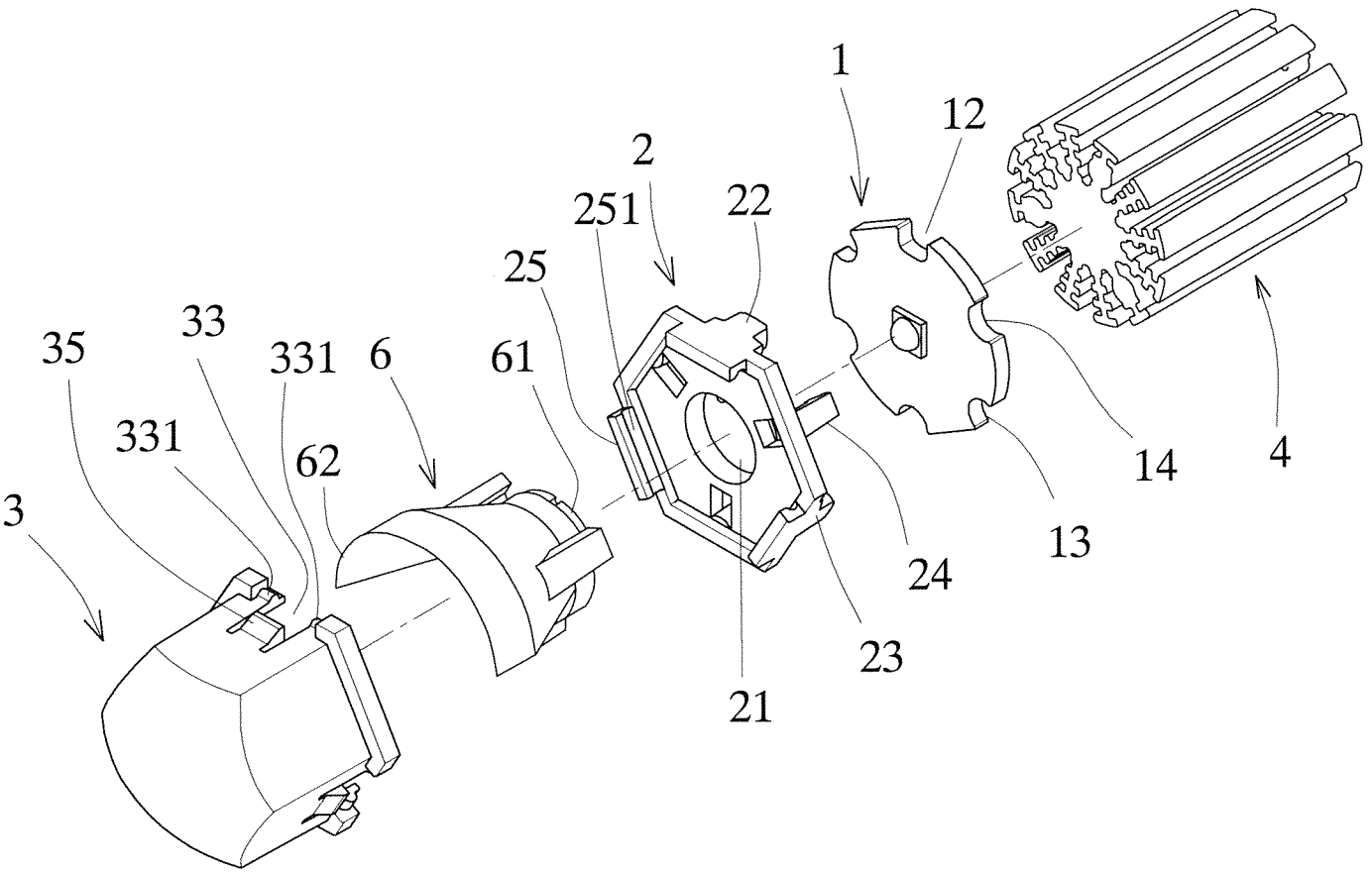
FIG. 10 is a perspective exploded view showing a sixth embodiment of a light convergence module with a heat dissipation function according to the present invention.

Referring to FIG. 10, a perspective exploded view showing a sixth embodiment of a light convergence module with a heat dissipation function according to the present invention is revealed. The light convergence module has two engaging slots (33) each having a protrusion (331) on two sides thereof for engaging with the engaging blocks (25) of the assembling unit (2) and a positioning portion (35) extended from an opening of the engaging slot (33). The locating block (22) correspondingly engages with the locating slot (12), the position limiting blocks (23) insert into the position limiting slots (13), and two buckles (24) of the assembling unit (2) correspondingly clasp the two concave slots (14) of the substrate (1), allowing the assembling unit (2) to closely dispose on the substrate (1).

Moreover, an assembling fringe (61) of the light reflecting semi-shield (6) is further provided for correspondingly inserting into the perforation (21) of the assembling unit (2). After the protrusions (331) of the engaging slots (33) engage with the engaging recesses (251) of the engaging blocks (25), the substrate (1), the assembling unit (2), the light reflecting semi-shield (6) and the light convergence lampshade (3) can be assembled together by the positioning portion (35) of the light convergence lampshade (3).

Figure 11:
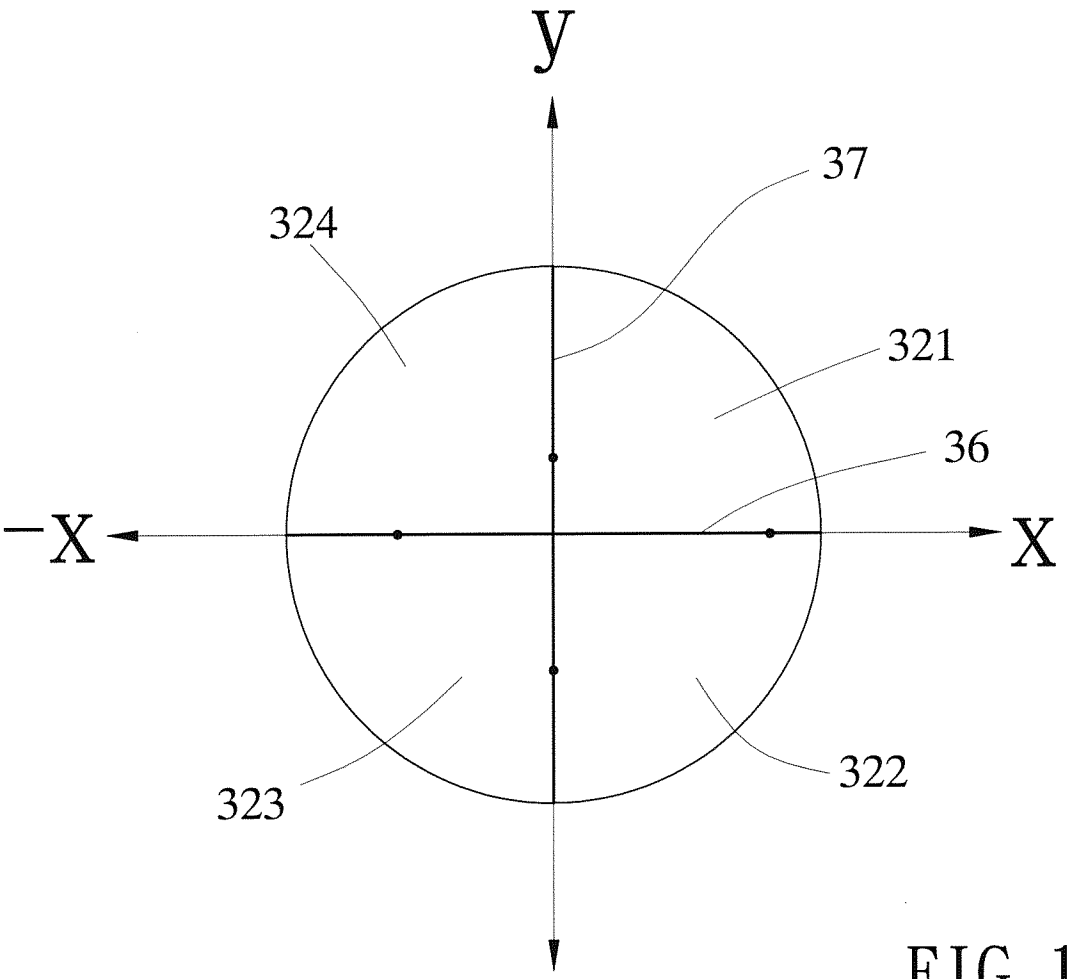
FIG. 11 is a diagram showing a light emission surface of the light convergence lampshade according to the present invention.

Referring to FIG. 11, as abovementioned light convergence modules with heat dissipation function shown in first to sixth embodiments, the light emission surface (32) of the light convergence lampshade (3) is divided into a first curved surface (321), a second curved surface (322), a third curved surface (323) and a fourth curved surface (324) in a clockwise direction based on an X axis (36) and a Y axis (37) intersecting with each other, the "axis" is defined as a boundary between two of the first, second, third and fourth curved surfaces (321) (322) (323) (324) adjacent to each other, an arbitrary dot at the "axis" has a curvature identical to the curvatures of two dots corresponding to the "axis" at the two adjacent curved surfaces, and an X-axis curvature is not equal to a Y-axis curvature when the X-axis curvature of the first and fourth curved surfaces (321) (324) is identical to that of the second and third curved surfaces (322) (323) and when the Y-axis curvature of the first and second curved surfaces (321) (322) is identical to that of the third and fourth curved surfaces (323) (324).

What is claimed is:

1. A light convergence module with a heat dissipation function, comprising:

a substrate having a luminous source in an center thereof and having a locating slot, a plurality of position limiting slots, and two concave slots on a bordering thereof, wherein each of the two concave slots is disposed between the locating slot and each of the plurality of position limiting slots or between two of the plurality of position limiting slots;

an assembling unit having a first surface and a second surface, wherein the first surface for assembling to the substrate comprises a perforation disposed coaxially relative to the luminous source for receiving the luminous source, a locating block for engaging with the locating slot, a plurality of position limiting blocks for correspondingly engaging with the plurality of position limiting slots, and two buckles for correspondingly clasping the two concave slots;

a light convergence lampshade assembling to the second surface of the assembling unit; and a heat sink having a plurality of main bodies radially extended from an center thereof, wherein each of the plurality of main bodies is provided with a plurality of heat dissipation fins on both sides thereof, and a plurality of interspaces are formed between every two adjacent heat dissipation fins for securing the buckles and allowing the heat sink to closely dispose on the substrate.

2. The light convergence module with a heat dissipation function as claimed in claim 1, wherein the light convergence module further has a collecting lens disposed coaxially relative to the luminous source for inserting in the perforation of the assembling unit, and wherein the collecting lens has an effective incidence angle equal to or greater than a reflection angle of the luminous source and has an reflection angle equal to or less than an effective incidence angle of the light convergence lampshade.

3. The light convergence module with a heat dissipation function as claimed in claim 2, wherein a first engagement portion is provided on a circumference of the perforation of the assembling unit, and a second engagement portion is provided on an outer sidewall of the collecting lens for correspondingly engaging with the first engagement portion.

4. The light convergence module with a heat dissipation function as claimed in claim 3, wherein a light emission surface of the light convergence lampshade is defined by an X-axis curvature and a Y-axis curvature, the X-axis and Y-axis curvatures being unequal.

5. The light convergence module with a heat dissipation function as claimed in claim 3, wherein the assembling unit has a plurality of engaging blocks each having an engaging recess on the second surface thereof, and the light convergence lampshade has a plurality of engaging slots, each of which has a protrusion on a side thereof for engaging with the engaging recess, so as to correspondingly receive the plurality of engaging blocks, and a rotary positioning groove extended from an opening of the engaging slot thereof.

6. The light convergence module with a heat dissipation function as claimed in claim 3, wherein the assembling unit has a plurality of engaging blocks each having an engaging recess on the second surface thereof, and the light convergence lampshade has a plurality of engaging slots, each of which has a protrusion on two sides thereof for engaging with the engaging recess, so as to correspondingly receive the plurality of engaging blocks, and a positioning portion extended from an opening of the engaging slot thereof.

7. The light convergence module with a heat dissipation function as claimed in claim 1, wherein the light convergence module further has a light reflecting semi-shield disposed between the light convergence lampshade and the assembling unit for reflecting and gathering a light scattered from an upper section of the luminous source to increase an area of a lower section of a projected light shape.

8. The light convergence module with a heat dissipation function as claimed in claim 7, wherein the assembling unit has a plurality of engaging blocks each having an engaging recess on the second surface thereof, and the light convergence lampshade has a plurality of engaging slots, each of which has a protrusion on two sides thereof for engaging with the engaging recess, so as to correspondingly receive the plurality of engaging blocks, and a positioning portion extended from an opening of the engaging slot thereof.

9. The light convergence module with a heat dissipation function as claimed in claim 1, wherein a light emission surface of the light convergence lampshade is defined by an X-axis curvature and a Y-axis curvature, the X-axis and Y-axis curvatures being unequal.

10. The light convergence module with a heat dissipation function as claimed in claim 9, wherein the assembling unit has a plurality of engaging blocks each having an engaging recess on the second surface thereof, and the light convergence lampshade has a plurality of engaging slots, each of which has a protrusion on a side thereof for engaging with the engaging recess, so as to correspondingly receive the plurality of engaging blocks, and a rotary positioning groove extended from an opening of the engaging slot thereof.

11. The light convergence module with a heat dissipation function as claimed in claim 9, wherein the assembling unit has a plurality of engaging blocks each having an engaging recess on the second surface thereof, and the light convergence lampshade has a plurality of engaging slots, each of which has a protrusion on two sides thereof for engaging with the engaging recess, so as to correspondingly receive the plurality of engaging blocks, and a positioning portion extended from an opening of the engaging slot thereof.

12. The light convergence module with a heat dissipation function as claimed in claim 9, wherein the light convergence module further has a light reflecting semi-shield disposed between the light convergence lampshade and the assembling unit for reflecting and gathering a light scattered from an upper section of the luminous source to increase an area of a lower section of a projected light shape.

* * * * *